US005395693A

United States Patent [19]

Cho et al.

[11] Patent Number: 5,395,693

[45] Date of Patent: Mar. 7, 1995

[54] CONJUGATED FILAMENT

[75] Inventors: Dae-hyun Cho, Daeku-si; Won-joon Kim, Seoul, both of Rep. of Korea

[73] Assignee: Kolon Industries, Inc., Seoul, Rep. of Korea

[21] Appl. No.: 82,726

[22] Filed: Jun. 28, 1993

[30] Foreign Application Priority Data

Jun. 26, 1992 [KR] Rep. of Korea ..... 92-11261
Dec. 24, 1992 [KR] Rep. of Korea ..... 92-25489

[51] Int. Cl.[6] ..... D02G 3/00

[52] U.S. Cl. ..... 428/373; 428/374; 428/370; 428/397

[58] Field of Search ..... 428/370, 373, 374, 397

[56] References Cited

U.S. PATENT DOCUMENTS

| | | | |
|---|---|---|---|
| 3,531,368 | 9/1970 | Okamoto | 428/374 |
| 3,718,534 | 2/1973 | Okamoto et al. | 428/374 |
| 3,968,307 | 7/1976 | Matsui et al. | 428/374 |
| 4,073,988 | 2/1978 | Nishida et al. | 428/374 |
| 4,122,658 | 10/1978 | Morioka et al. | 37/140 B |
| 4,233,355 | 11/1980 | Sato et al. | 428/374 |
| 4,343,801 | 8/1982 | Gerlach et al. | 428/374 |
| 4,364,983 | 12/1982 | Brucher et al. | 428/374 |
| 4,381,335 | 4/1983 | Okamoto | 428/373 |
| 4,496,619 | 1/1985 | Okamoto | 428/374 |
| 4,966,808 | 10/1990 | Kawano | 428/374 |
| 5,124,194 | 6/1992 | Kawano | 428/373 |

FOREIGN PATENT DOCUMENTS

| | | |
|---|---|---|
| 55-71817 | 5/1980 | Japan . |
| 59-187672 | 10/1984 | Japan . |
| 62-78213 | 4/1987 | Japan . |
| 63-20939 | 5/1988 | Japan . |
| 1-162825 | 6/1989 | Japan . |

OTHER PUBLICATIONS

Perry's Chemical Engineer's Handbook 6th Edition 1963 pp. 1–2.

*Primary Examiner*—N. Edwards
*Attorney, Agent, or Firm*—Oblon, Spivak, McClelland, Maier & Neustadt

[57] ABSTRACT

A binary conjugated filament comprising one polymer component (A) and a polymer component (B) which is more soluble than polymer (A), the cross-sectional configuration of the filament being such that the polymer component (A) is divided into not less than five segments by the polymer component (B) and one of these segments is disposed in the center of the other segments, the areal center of the central segment residing on the line (r) in the range of: $R/300 \leqq r \leqq R/2$ wherein R is the radius of the circular cross-section of the conjugated filament and r is the length from the areal center of the cross-section of the conjugated filament to the areal center of the segment disposed in the center of the other segments. The filament may be made into a woven or knitted fabric which is treated to remove the more soluble polymer component (B) to provide a fabric product exhibiting good handle characteristics.

7 Claims, 2 Drawing Sheets

CONJUGATED FILAMENT

BACKGROUND OF THE INVENTION

(1) Field of the Invention

The present invention relates to a conjugated filament, and in particular to a conjugated filament from which woven or knitted fabrics having excellent softness and drapability can be made. The woven fabric or knitted fabric is prepared and the more soluble polymer component is removed by extraction to obtain a superfine filament consisting of the less soluble polymer segments.

(2) Description of the Background

The technology of conjugated filaments in which filament is made into a fabric and one polymer component is removed therefrom by extraction to get a superfine filament consisting of the segments of the other polymer is disclosed in, by way of example, Japanese patent publication no. sho 48-28005 and Japanese laid-open no. pyung 1-162813.

The conjugated filaments disclosed in Japanese patent publication no. sho. 48-28005 and Japanese laid-open application 1-162813 have cross-sectional configurations as shown in FIGS. 1A and 1B, where conjugated filaments 1 are formed of a polymer A divided into segments 2 by portions 3 of polymer B. The above conjugated filaments having such a cross-sectional configuration cannot provide a fabric having a soft feel which originates from superfine filaments, because, after removing the radial-shaped polymer which is the more soluble polymer component, the remaining polymer segments accumulate so that the effect of high fineness cannot be obtained though segmentation may be achieved. A need therefore continues to exist for a filament, which, after removal of the soluble component from a conjugated filament, provides a filament product having acceptable characteristics.

SUMMARY OF THE INVENTION

Accordingly one object of the invention is to produce a conjugated filament for a woven or knitted fabric which has excellent softness and drapability by controlling the fineness and specific surface area of the segments composing the filament so that they are distributed within specified ranges.

Briefly, this object and other objects of the present invention as hereinafter will become more readily apparent can be attained by a conjugated filament for producing a superfine filament, comprising one polymer component (A) and another polymer component (B) which is more soluble than polymer (A), the improvement comprising said conjugated filament having a cross-sectional configuration in which the polymer component (A) is divided into not less than five segments by the polymer component (B) and one of these segments is disposed in the center of the other segments, provided that the areal center of the segment is on the line (r) satisfying the following condition:

$$\frac{R}{300} \leqq r \leqq \frac{R}{2}$$

wherein R is the radius of the circular cross-section of the conjugated filament and r is the length from the areal center of the cross-section of the conjugated filament to the areal center of the segment disposed in the center of the other segments.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The problem of the conventional conjugated filament that the segments which remain after extracting one polymer component tend to accumulate originates from the geometrical structure of filament cross-section such that the remaining segments are arranged symmetrically around the center of the cross-section. For this reason, disproportion of the stress to which the filament is subjected after dividing into segments cannot be achieved.

The present invention has been made based upon the discovery that the problems of the prior art originate from the accumulation of the segments remaining after extraction. These problems can be solved and the softness and drapability of the fabrics prepared can be improved by modifying the cross-sectional structure of a conjugated filament so that the stress which the filament receives after extraction and removal of one polymer component is disproportionate, and by controlling the fineness and specific surface area within specified ranges.

The present invention will be described in detail referring to the figures.

The conjugated filament of the present invention is a conjugated filament comprising a polymer component (A) and a polymer component (B) which is more soluble than the polymer component (A). The filament is characterized by a filamentary cross-section wherein the polymer component (A) is divided into not less than five segments by the polymer component (B) and one segment of polymer (A) is located in the center of the other segments provided that the areal center of the central segment is on the line (r) which satisfies the relationship: $R/300 \leqq r \leqq R/2$. Herein, R represents the radius of the cross-section of the conjugated filament and r represents the length from the areal center of the cross section of the fiber to the areal center of the segment located in the center of the other segments.

Hereinafter, polymer (A) and polymer (B) represent the less and the more soluble polymer components which form the bi-component conjugated filament of this invention.

In addition, the present filament is characterized in the segments of polymer (A) is divided into not less than five segments by portions of polymer (B), and one segment of polymer (A) is located in the center of the other segments of polymer (A) and the other segments of polymer (A) are arranged around the center segment in such a fashion that the sizes of the segments of polymer (A) are not equal. Additionally, the present filament comprises 10 to 40, preferably 15 to 30 percent by weight of polymer (B) and 60 to 90, preferably 70 to 85 percent by weight of polymer (A).

Figure 1A:
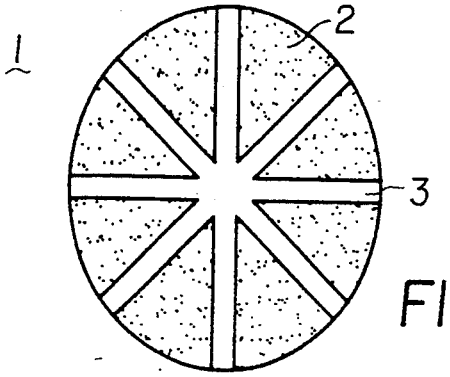
FIGS. 1A and 1B are example of the cross-sectional view of conjugated filaments of the prior art.
Figure 1B:
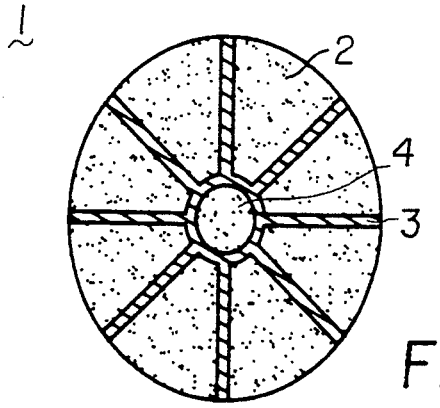
Figure 2:
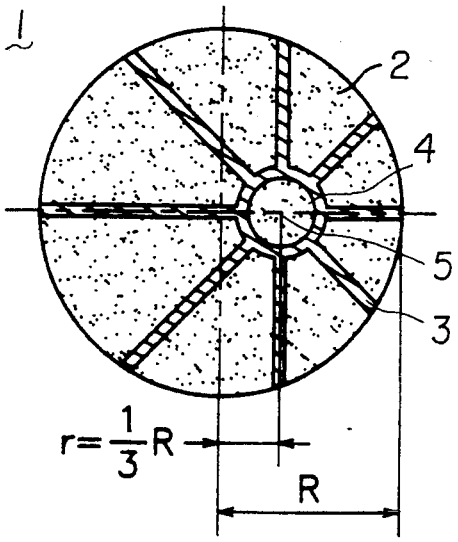
FIG. 2 is an example of the cross-sectional view of the conjugated filament of the present invention.

FIG. 2 illustrates an example of the cross section of the present conjugated filament 1. In the figure, polymer (A) is divided into nine segments 2 by portions 3 of polymer (B) but the areal center of the segment located in the center of the other segments is at the point of $r=R/3$ which satisfies the relationship $R/300 \leqq r \leqq R/2$. Accordingly, the sizes of the nine segments 1 are not equal and this configuration enables a disproportionate stress to which the filament is subjected after one component is removed by extraction, thus significantly reducing the accumulation of segments. When the areal center 5 of the segment 4 located in the center of the other segments is on the line $r>R/2$, the disproportionate stress may be accelerated, but the processability, particularly the yarn-making property may deteriorate. This is not desirable. Additionally, when the areal center 5 of the segment 4 located in the center of the other segments is on the line $r<R/300$, the disproportionate stress may be unsatisfactory.

It is preferred that the number of segments 2 remaining after extraction should not be less than 5 in order to obtain super fine filaments and thus produce a conjugated filament for a woven or knitted fabric with voluminous feel and softness, and no more than twenty two to prepare a filament of good processability and to permit precision manufacture of spinning assemblies. The number of segments 2 remaining preferably range from 6 to 14. In general, polymer (B) has a lower softening point and greater water and oil absorbency than polymer (A). This becomes a major cause of the adhesion among the filaments. In order to prevent this adhesion, it is necessary that part of the polymer (B) occupy the surface area of the filament. In addition, the segments of polymer (A) should be clearly divided by polymer (B). In order to achieve this, the lower limit of the proportion of polymer (B) should be defined. The upper limit of the proportion of polymer (B) also needs to be defined in order to eliminate the reduction of handle effected by decreased closeness of woven or knitted fabric due to excessive extraction of polymer (B).

It is known from repeated experiments that where the upper and the lower limit of polymer (B) are maintained such that the proportions of polymer (A) and polymer (B) are in the range of 60 to 90, preferably 70 to 85 percent by weight and 10 to 40, preferably 15 to 30 percent by weight, respectively the above requirement is satisfied appropriately. Thus, according to the present invention, the accumulation of the segments remaining after extraction can be improved which is a defect of the conventional conjugated filament.

It has also now been confirmed by repeated experiments that, in order to produce a conjugated filament with softness and drapability as well as the above characteristics, the fineness and the specific area need to be maintained in the specified range which satisfies the relationship:

i) $0.05 \leqq D \leqq 0.9$ and ii) $3{,}000 \leqq V \leqq 30{,}000$ wherein, D represents the fineness (denier) of the segments formed from polymer (A) remaining after extracting polymer (B) having a higher solubility, and V represents the specific surface area ($cm^2/g$) of the segments formed from polymer (A) remaining after extracting polymer (B) having a higher solubility.

When D is less than 0.05, the softness due to superfineness can be improved but the drapability may be seriously adversely affected which leads to a fall-off in quality of the products. On the other hand, when D is greater than 0.9, the drapability can be improved but the softness may decrease.

The purpose of defining the distribution range of specific surface area ($cm^2/g$) of the segments formed from polymer (A) remaining after extracting polymer (B) within the range of 3,000 to 30,000 is to compensate the loss of drapability or softness which originates from the distribution of fineness. When V is less than 3,000, the compensation for loss of softness is insufficient and when it is greater than 30,000, the softness is good but the drapability may be reduced and the processing of the melt-spinning apparatus becomes impractically difficult.

Suitable examples of polymer (A) component include a polymer having a fiber-forming property such as polyamide, polyester, polyolefin or the like. Examples of polyamides include nylon 6, nylon 66, nylon 11, nylon 12, nylon 610 and various copolymerized polyamides obtained by copolymerizing the same as a major ingredient. Examples of polyesters include polyethylene terephthalate, polybutylene terephthalate, polyethylene oxybenzoate, poly-1,4-dimethylcyclohexane terephthalate and various copolymerized polyesters obtained by copolymerizing the same as a major ingredient. Examples of polyolefins include polyethylene and polypropylene. Besides the polymers described above, any polymer which has fiber-forming properties can be used as polymer (A) in the conjugated filament of the present invention.

As to polymer (B), which has a higher solubility than polymer (A), a polymer must be used which can be extracted easily when used in combination with polymer (A). When polymer (A) is a polyamide, polyester or polyethylene, polymer (B) may be suitably a copolymerized polyester obtained by copolymerizing one or two kind(s) of dicarboxylic acid besides terephthalic acid, having a polyalkylene glycol or metal sulfonate group, but not limited to it.

An example of the production of a conjugated filament of the present invention is described with reference to FIGS. 3 and 4.

Figure 3:
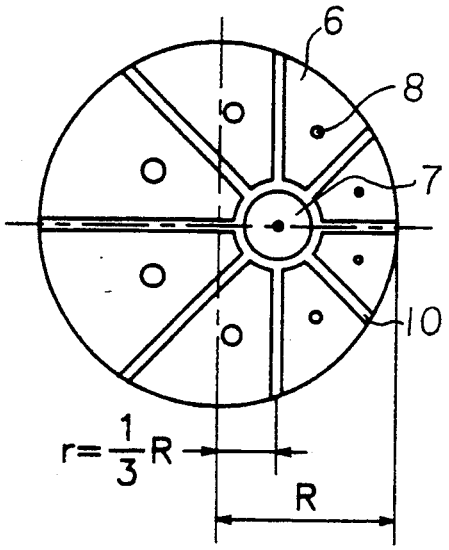
FIG. 3 is an example of the cross-sectional view of the distributor used to produce a conjugated filament of the present invention.

FIG. 3 illustrates an example of the cross-sectional view of the distributor 12 used to produce a conjugated filament of the present invention which has a cross-sectional configuration the same as FIG. 2, wherein plates 6, each having discharge openings 8, have the same shape as the counterpart segments of polymer A in FIG. 2. Portions 10 correspond to polymer B portions 3 in FIG. 2 and central plate 7 corresponds to segment 4 of FIG. 2.

Figure 4:
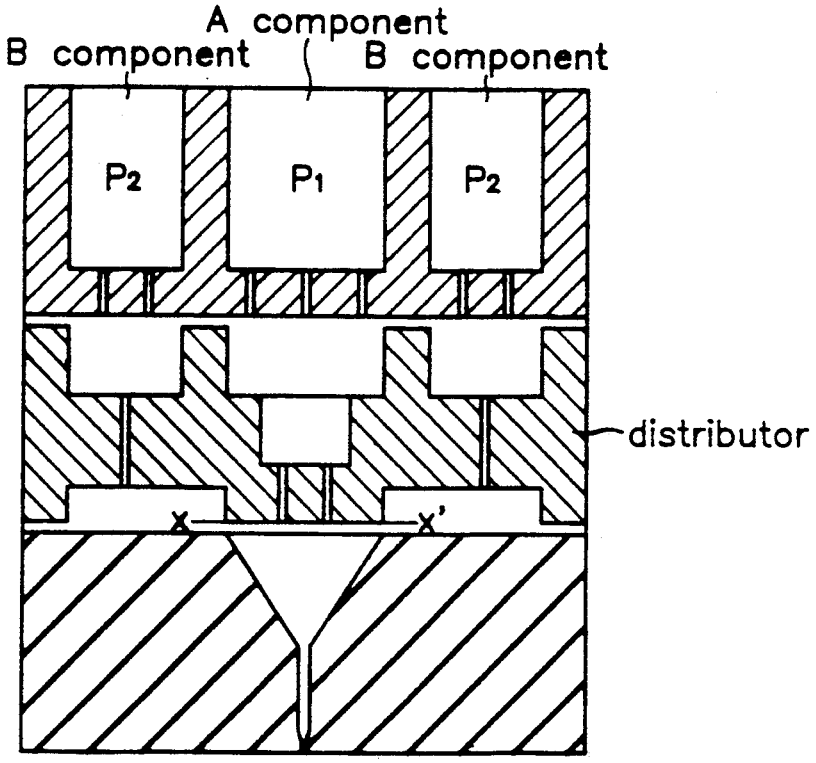
FIG. 4 is an example of the longitudinal sectional view of the spinneret assembly used to produce a conjugated filament of the present invention.

FIG. 4 illustrates an example of the longitudinal view of the spinneret used to produce a conjugated filament of the present invention. Polymer (A) and polymer (B) are introduced into P1 and P2 respectively, filtered and passed through the distributor. Thereafter, the two components are combined to form a conjugated cross-section at the X—X' section and are spun through the spinneret inlet into an orifice.

A conjugated filament having a cross-sectional configuration according to the present invention can be easily produced by setting up the areas of the (A) and (B) components and the polymer flow path in the distributor to satisfy the requirements of the present invention.

After discharging conjugated filament through the spinneret orifice, the filament is solidified by quenching, it is treated with spin finishes and wound in a winding machine at a speed of 800 to 3,000 m/min. The undrawn yarn produced is, in case of filamentary yarn, preheated with a hot roller at a temperature of 70° to 100° C. and then drawn at a draw ratio of 1.5 to 4.5 and heat-set by a hot plate at a temperature of 100° to 180° C. to produce a drawn yarn. The obtained conjugated filament can be converted to a superfine filament made of polymer (A) by extracting polymer (B) having a higher solubility.

Having generally described this invention, a further understanding can be obtained by reference to certain specific examples which are provided herein for purposes of illustration only and are not intended to be limiting unless otherwise specified.

EXAMPLES

In the examples and comparative examples, the fabrics made from the conjugated filament are tested to evaluate handle. Handle is evaluated by measuring the tensile properties, shearing properties, compression properties, surface properties and bending properties in accordance with the KES method (Kawabata, "The Standardization and Analysis of Handle evaluation", 2nd edition, published by the Textile Machinery Society in Japan, 1980) and converting the measured handle factor to a numerical value using a computer. Herein, the constant is one for KN-202-LDY-FILAMENT. In addition, the specific surface area of the segments made of polymer (A) remaining after extracting polymer (B) having a higher solubility is obtained by measurement using an image analyzer (IBAS-2000, manufactured by KONTRON Co. in Germany) and calculated based upon the density of polymer (A) (polyester: 1.38 g/cm$^3$, nylon 6:1.14 g/cm$^3$).

EXAMPLE 1

To produce a binary conjugated filament, a conjugated spinning process is carried out using 75 percent by weight of polyethylene terephthalate having an inherent viscosity of 0.63 (25° C., in orthochlorophenol) as the polymer (A) component and 25 percent by weight of copolyethylene terephthalate, containing 6 mol % sulfonate salt, having an inherent viscosity of 0.59 (25° C., in orthochlorophenol) as the polymer (B) component.

In the process, the conjugated filament is melt-spun at a spinning temperature of 290° C. by using a spinneret assembly with 36 orifices, each 0.23 mm in diameter and distributors designed to satisfy that the number of segments made of polymer (A) is 9, among them one segment being disposed in the center of the other eight segments, the areal center of the segment located in the center of the other segments is at r=1R/100, and the fineness and specific surface areas of the segments made of polymer (A) after extracting polymer (B) are distributed from 0.2 to 0.8 denier and from 4,200 to 14,500 cm$^2$/g respectively.

Thereafter, the filaments are quenched in air and taken up at 1300 m/min speed, and drawn in a heat drawing machine at a hot roller temperature of 75° C., a hot plate temperature of 135° C. and a draw ratio of 3 to obtain a conjugated filament of 120 denier / 36 filaments.

The obtained conjugated filament is twisted at 800 T/M. By using the twisted yarn as a warp and polyethylene terephthalate filaments of 75 deniers / 72 filaments, which are not conjugated filaments, as a weft, a plain fabric was woven which has a warp density of 126 ends / inch a weft density of 70 picks / inch. The fabric is released in 40 g/l aqueous sodium hydroxide solution at 95° C. for 50 minutes in a continuous scouring machine to extract the polymer (B) component having a higher solubility, and is subjected to presetting at 190° C. over 45 seconds, and dyeing, and then final setting at 170° C. over 40 seconds.

The finally obtained fabric is evaluated for handle in accordance with the KES method and the results obtained are shown in Table 1.

EXAMPLE 2

In this example substantially the same procedure as described in Example 1 is repeated except that the polymer (A) component is 85 percent by weight of polyethylene terephthalate having an inherent viscosity of 0.63 (25° C., in orthochlorophenol) and the polymer (B) component is 15 percent by weight of copolyethylene terephthalate, containing 6 mol% sulfonate salt, having an inherent viscosity of 0.59 (25° C., in orthochlorophenol) respectively. The spinneret assembly used has 36 orifices each 0.23 mm in diameter and distributors designed to satisfy that the number of segments made of polymer (A) is 9, among them one segment being disposed in the center of the other eight segments. The areal center of this segment located in the center of the other segments is at r=1R/50, and the fineness and specific surface areas of the segments made of polymer (A) after extracting polymer (B) are distributed from 0.1 to 0.7 denier and from 4,500 to 16,500 cm$^2$/g respectively. Substantially the same procedure is repeated as set forth in Example 1 to produce a conjugated filament, then a plain fabric. The finally obtained fabric is evaluated for handlability in accordance with the KES method and the results obtained are shown in Table 1.

EXAMPLE 3

In this example substantially the same procedure as described in Example 1 is repeated except that the polymer (A) component is 80 percent by weight of polyethylene terephthalate having an inherent viscosity of 0.63 (25° C., in orthochlorophenol) and the polymer (B) component is 20 percent by weight of copolyethylene terephthalate, containing 6 mol % sulfonate salt, having an inherent viscosity of 0.59 (25° C., in orthochlorophenol) respectively. The spinneret assembly used has 36 orifices each 0.23 mm in diameter and distributors designed to satisfy that the number of segments made of polymer (A) are 7, among them one segment being disposed in the center of the other 6 segments. The areal center of the segment located in the center of the other segments is r=1R/3, and the fineness and specific surface areas of the segments made of polymer (A), after extracting polymer (B), are distributed from 0.1 to 0.9 denier and from 3,400 to 17,000 cm$^2$/g respectively. Substantially the same procedure as that of Example 1 is repeated to produce a plain fabric. The finally obtained fabric is evaluated for handle in accordance with the KES method and the results obtained are shown in Table 1.

EXAMPLE 4

In this Example substantially the same procedure as described in Example 1 is employed except that the polymer (A) component is 75 percent by weight of polyethylene terephthalate having an inherent viscosity of 0.63 (25° C., in orthochlorophenol) and the polymer (B) component is 25 percent by weight of copolyethylene terephthalate, containing 6 mol % sulfonate salt, having an inherent viscosity of 0.59 (25° C., in orthochlorophenol) respectively. The spinneret assembly used has 36 orifices each 0.23 mm in diameter and distributors designed to satisfy that the number of segments made of polymer (A) is 18, among them one segment being disposed in the center of the other 17 segments. The areal center of the segment located in the center of the other segments is r=1R/3, and the fineness and specific surface areas of the segments made of polymer (A) after extracting polymer (B), are distributed from 0.06 to 0.5 denier and from 6,000 to 26,300 $cm^2/g$ respectively. Substantially the same procedure is repeated as that of Example 1 to produce a plain fabric. The finally obtained fabric is evaluated for handle in accordance with the KES method and the results are obtained shown in Table 1.

EXAMPLE 5

In this example substantially the same procedure as described in Example 1 is repeated except that the polymer (A) component is 65 percent by weight of polyethylene terephthalate having an inherent viscosity of 0.63 (25° C., in orthochlorophenol) and the polymer (B) component is 35 percent by weight of copolyethylene terephthalate, containing 6 mol % sulfonate salt, having an inherent viscosity of 0.59 (25° C., in orthochlorophenol) respectively. The spinneret assembly used has 36 orifices each 0.23 mm in diameter and distributors designed to satisfy that the number of segments made of polymer (A) is 9, among them one segment being disposed in the center of the other eight segments. The areal center of the segment located in the center of the other segments is at r=1R/50, and the fineness and specific surface areas of the segments made of polymer (A), after extracting polymer (B), are distributed from 0.1 to 0.5 denier and from 5,500 to 15,000 $cm^2/g$ respectively. Substantially the same procedure is repeated as that of Example 1 to produce a plain fabric. The finally obtained fabric is evaluated for handle in accordance with the KES method and the results obtained are shown in Table 1.

EXAMPLE 6

To produce a conjugate filament, a conjugated spinning process is carried out using 80 percent by weight of Nylon 6 having a relative viscosity of 2.45 (25° C., in 98% sulfuric acid) as the polymer (A) component and 20 percent by weight of copolyethylene terephthalate, containing 6 mol % sulfonate salt, having an inherent viscosity of 0.59 (25° C., in orthochlorophenol) as the polymer (B) component. In the process, the conjugated filament is melt-spun at a spinning temperature of 290° C. using a spinneret assembly having 36 orifices each 0.23 mm in diameter and distributors designed to satisfy that the number of segments made of polymer (A) is 9, among them one segment being disposed in the center of the other eight segments. The areal center of the segment located in the center of the other segments is at r=1R/100, and the fineness and specific surface areas of the segments made of polymer (A), after extracting polymer (B), are distributed from 0.2 to 0.8 denier and from 4,500 to 13,000 $cm^2/g$ respectively. Thereafter, the filament is quenched in air and taken up at 1300 m/min speed and drawn in a heat drawing machine at a hot roller temperature of 75° C., a hot plate temperature of 135° C. and a draw ratio of 3 to obtain a conjugated filament of 120 denier/36 filaments. The conjugated filament is twisted at 800 T/M. By using the twisted yarn as warp and Nylon 6 filament of 75 deniers/48 filaments which is not a conjugated filament, as weft, a plain fabric is woven which has a warp density of 126 ends/inch and a weft density of 70 picks/inch. The fabric is released in 40 g/l aqueous sodium hydroxide solution at 95° C. for 50 minutes in a continuous scouring machine to extract the polymer (B) component having a higher solubility, and is subjected to presenting at 180° C. over 45 seconds, dyeing and then final setting at 160° C. over 45 seconds. The finally obtained fabric is evaluated for handle in accordance with the KES method and the results obtained are shown in Table 1.

EXAMPLE 7

In this example substantially the same procedure as described in Example 6 is repeated except that the polymer (A) component is 75 percent by weight of Nylon 6 having a relative viscosity of 2.45 (25° C., in 98% sulfuric acid) and the polymer (B) component is 25 percent by weight of copolyethylene terephthalate, containing 6 mol % sulfonate salt, having an inherent viscosity of 0.59 (25° C., in orthochlorophenol) respectively. The spinneret assembly used has 36 orifices, each 0.23 mm in diameter, and distributors designed to satisfy that the number of segments made of polymer (A) is 18, among them one segment being disposed in the center of the other 17 segments, and the areal center of the segment located in the center of the other segments is at r=1R/3. The fineness and specific surface areas of the segments made of polymer (A) after extraction of polymer (B) are distributed from 0.06 to 0.5 denier and from 6,300 to 23,000 $cm^2/g$ respectively. Substantially the same procedure is repeated as in Example 6 to produce a plain fabric. The finally obtained fabric is evaluated for handle in accordance with the KES method and the results obtained are shown in Table 1.

EXAMPLE 8

In this example substantially the same procedure of Example 1 is repeated except that the polymer (A) component is 75 percent by weight of polyethylene terephthalate having an inherent viscosity of 0.63 (25° C., in orthochlorophenol) and the polymer (B) component is 25 percent by weight of copolyethylene terephthalate, containing 6 mol % sulfonate salt, having an inherent viscosity of 0.59 (25° C., in orthochlorophenol) respectively. The spinneret assembly used has 36 orifices each 0.23 mm in diameter, and distributors designed to satisfy that the number of segments made of polymer (A) is 9, among them one segment being disposed in the center of the other eight segments. The areal center of the segment located in the center of the other segments is at r=1R/300, and the fineness and specific surface areas of the segments made of polymer (A), after extracting polymer (B) are distributed from 0.05 to 0.6 denier and from 4,200 to 21,000 $cm^2/g$ respectively. Substantially the same procedure is repeated as described in Example 1 to produce a plain fabric. The finally obtained fabric is evaluated for handle in accordance with the KES method and the results obtained are shown in Table 1.

EXAMPLE 9

In this example substantially the same procedure of Example 1 is repeated except that the polymer (A) component is 75 percent by weight of polyethylene terephthalate having an inherent viscosity of 0.63 (25° C., in orthochlorophenol) and the polymer (B) component is 25 percent by weight of copolyethylene terephthalate, containing 6 mol % sulfonate salt, having an inherent viscosity of 0.59 (25° C., in orthochlorophenol) respectively. The spinneret assembly used has 36 orifices each 0.23 mm in diameter and distributors designed to satisfy that the number of segments made of polymer (A) is 9, among them one segment being disposed in the center of the other eight segments. The areal center of the segment located in the center of the other segments is at r=1R/2, and the fineness and specific surface areas of the segments made of polymer (A), after extracting polymer (B), are distributed from 0.1 to 0.8 denier and from 3,500 to 14,000 $cm^2/g$ respectively. Substantially the same procedure is repeated as that of Example 1 to produce a plain fabric. The finally obtained fabric is evaluated for handle in accordance with the KES method and the results obtained are shown in Table 1.

COMPARATIVE EXAMPLE 1

In this example substantially the same procedure of Example 1 is repeated except that the spinneret assembly has a distributor designed to satisfy that the number of segments made of polymer (A) is 8, the sizes and shapes of the segments are all the same and with no segment being disposed in the center of the segments. Further, the fineness and specific surface area of the segments are 0.31 denier and 8,600 $cm^2/g$ respectively. Substantially the same procedure is repeated as described in Example 1 to produce a plain fabric. The finally obtained fabric is evaluated for handle in accordance with the KES method and the results obtained are shown in Table 1.

COMPARATIVE EXAMPLE 2

In this example substantially the same procedure of Example 1 is repeated except that the polymer (A) component is 75 percent by weight of polyethylene terephthalate having an inherent viscosity of 0.63 (25° C., in orthochlorophenol) and the polymer (B) component is 25 percent by weight of copolyethylene terephthalate, containing 6 mol % sulfonate salt, having an inherent viscosity of 0.59 (25° C. in orthochlorophenol) respectively. The spinneret assembly used has 36 orifices, each 0.23 mm in diameter, and distributors designed to satisfy that the number of segments made of polymer (A) is 9, among them one segment being disposed in the center of the other eight segments. The areal center of the segment located in the center of the other segments is at r=0, and the fineness and specific surface areas of the segments made of polymer (A) after extracting polymer (B), are distributed from 0.2 to 0.8 denier and from 3,200 to 12,000 $cm^2/g$ respectively. Substantially the same procedure as that of Example 1 is repeated to produce a plain fabric. The finally obtained fabric is evaluated for handle in accordance with the KES method and the results obtained are shown in Table 1.

COMPARATIVE EXAMPLE 3

In this example substantially the same procedure of Example 1 is repeated except that the polymer (A) component is 80 percent by weight of polyethylene terephthalate having an inherent viscosity of 0.63 (25° C., in orthochlorophenol) and the polymer (B) component is 20 percent by weight of copolyethylene terephthalate, containing 6 mol % sulfonate salt, having an inherent viscosity of 0.59 (25° C., in orthochlorophenol) respectively. The spinneret assembly used has 36 orifices each 0.23 mm in diameter, and distributors designed to satisfy that the number of segments made of polymer (A) is 7, among them one segment being disposed in the center of the other 6 segments. The areal center of the segment located in the center of the other segments is at r=1R/3, and the fineness and specific surface areas of the segments made of polymer (A) after extracting polymer (B) are distributed from 0.2 to 1.2 denier and from 2,700 to 9,800 $cm^2/g$ respectively. Substantially same procedure is repeated as described in Example 1 to produce a plain fabric. The finally obtained fabric is evaluated for handleability in accordance with the KES method and the results obtained are shown in Table 1.

COMPARATIVE EXAMPLE 4

In this example substantially the same procedure of Example 1 is repeated except that the polymer (A) component is 80 percent by weight of polyethylene terephthalate having an inherent viscosity of 0.63 (25° C., in orthochlorophenol) and 20 percent by weight of copolyethylene terephthalate, containing 6 mol % sulfonate salt, having an inherent viscosity of 0.59 (25° C., in orthochlorophenol) respectively. The spinneret assembly used has 36 orifices, each 0.23 mm in diameter and distributors designed to satisfy that the number of segments made of polymer (A) is 7, among them one segment being disposed in the center of the other 6 segments. The areal center of the segment located in the center of the other segments is at r=3R/5, and the fineness and specific surface areas of the segments made of polymer (A), after extracting polymer (B), are distributed from 0.1 to 0.9 denier and from 3,100 to 16,000 $cm^2/g$ respectively. Substantially the same procedure is repeated as that of Example 1 to produce a plain fabric. The finally obtained fabric is evaluated for handle in accordance with the KES method and the results obtained are shown in Table 1.

COMPARATIVE EXAMPLE 5

In this example substantially the procedure of Example 1 is repeated except that the polymer (A) component is 60 percent by weight of polyethylene terephthalate having an inherent viscosity of 0.63 (25° C., in orthochlorophenol) and the polymer (B) component is 40 percent by weight of copolyethylene terephthalate, containing 6 mol % sulfonate salt, having an inherent viscosity of 0.59 (25° C., in orthochlorophenol) respectively. The spinneret assembly used has 36 orifices, each 0.23 mm in diameter, and distributors designed to satisfy that the number of segments made of polymer (A) is 18, among them one segment being disposed in the center of the other 17 segments. The areal center of the segment located in the center of the other segments is at r=2R/3, and the fineness and specific surface areas of the segments made of polymer (A), after extracting polymer (B), are distributed from 0.04 to 0.3 denier and from 8,200 to 31,000 $cm^2/g$ respectively. Substantially the same procedure is repeated as that of Example 1 to produce a plain fabric. The finally obtained fabric is evaluated for handle in accordance with the KES method and the results obtained are shown in Table 1.

COMPARATIVE EXAMPLE 6

In this example substantially the procedure of Example 1 is repeated except that the polymer (A) component is 60 percent by weight of polyethylene terephthalate having an inherent viscosity of 0.63 (25° C., in orthochlorophenol) and the polymer (B) component is 40 percent by weight of copolyethylene terephthalate, containing 6 mol % sulfonate salt, having an inherent viscosity of 0.59 (25° C., in orthochlorophenol) respectively. The spinneret assembly used has 36 orifices, each 0.23 mm in diameter, and distributors designed to satisfy that the number of segments made of polymer (A) is 6, with no segment being disposed in the center of the segments. The distance (rl) from the center (0) of the cross-section of the conjugated filament to the configurational center of the polymer (B) are 1R/3, and the fineness and specific surface areas of the segments made of polymer (A), after extracting polymer (B), are distributed from 0.1 to 0.5 denier and from 6,500 to 14,000 $cm^2/g$ respectively. Substantially the same procedure is repeated as described in Example 1 to produce a plain fabric. The finally obtained fabric is evaluated for handle in accordance with the KES method and the results obtained are shown is Table 1.

COMPARATIVE EXAMPLE 7

In this example substantially the procedure of Example 1 is repeated except that the polymer (A) component is 50 percent by weight of polyethylene terephthalate having an inherent viscosity of 0.63 (25° C., in orthochlorophenol) and the polymer (B) component is 50 percent by weight of copolyethylene terephthalate, containing 6 mol % sulfonate salt, having an inherent viscosity of 0.59 (25° C., in orthochlorophenol) respectively. The spinneret assembly used has 36 orifices, each 0.23 mm in diameter, and distributors designed to satisfy that the number of segments made of polymer (A) is 7, among them one segment being disposed in the center of the other six segments, the areal center of the segment located in the center of the other segments is at $r=3R/5$, and the fineness and specific surface areas of the segments made of polymer (A), after extracting polymer (B), are distributed from 0.08 to 0.5 denier and from 6,300 to 23,000 $cm^2/g$ respectively. Substantially the same procedure is repeated as described in Example 1 to produce a plain fabric. The finally obtained fabric is evaluated for handle in accordance with the KES method and the results obtained are shown in Table 1.

COMPARATIVE EXAMPLE 8

In this example substantially the procedure of Example 6 is repeated except that polymer (A) component is 80 percent by weight of Nylon 6 having a relative viscosity of 2.45 (25° C., in 98% sulfuric acid) and the polymer (B) component is 20 percent by weight of copolyethylene terephthalate, containing 6 mol % sulfonate salt, having an inherent viscosity of 0.59 (25° C., in orthochlorophenol) respectively. The spinneret assembly used has 36 orifices, each 0.23 mm diameter, and distributors designed to satisfy that the number of segments made of polymer (A) is 9, among them one segment being disposed in the center of the other eight segments. The areal center of the segment located in the center of the other segments is at $r=0$, and the fineness and specific surface areas of the segments made of polymer (A), after extracting polymer (B), are distributed from 0.28 denier and from 6,800 to 8,600 $cm^2/g$ respectively. Substantially the same procedure is repeated as described in Example 6 to produce a plain fabric. The finally obtained fabric is evaluated for handle in accordance with the KES method and the results obtained are shown in Table 1.

COMPARATIVE EXAMPLE 9

In this example substantially the procedure of Example 6 is repeated except that the polymer (A) component is 92 percent by weight of Nylon 6 having a relative viscosity of 2.45 (25° C., in 98% sulfuric acid) and the polymer (B) component is 8 percent by weight of copolyethylene terephthalate, containing 6 mol % sulfonate salt, having an inherent viscosity of 0.59 (25° C., in orthochlorophenol) respectively. The spinneret assembly used has 36 orifices, each 0.23 mm in diameter, and distributors designed to satisfy that the number of segments made of polymer (A) is 7, with no segment being disposed in the center of the segments, possessing the same sizes and shapes, and the fineness and specific surface areas of the segments made of polymer (A) after extracting polymer (B) being 0.43 denier and 7,300 $cm^2/g$ respectively. Substantially the same procedure is repeated as that of Example 6 to produce a plain fabric. The finally obtained fabric is evaluated for handlability in accordance with the KES method and the results obtained are shown in Table 1.

TABLE 1

| Example No. | KOSHI (stiffness) | HARI (anti-drapability) | NUMERI (softness) | yarn-making property |
|---|---|---|---|---|
| Example 1 | 9.3 | 8.9 | 8.5 | 0.5% |
| Example 2 | 9.1 | 8.7 | 9.3 | 1.1% |
| Example 3 | 9.5 | 9.2 | 8.9 | 1.5% |
| Example 4 | 8.8 | 8.6 | 9.8 | 1.7% |
| Example 5 | 8.6 | 8.4 | 8.8 | 1.0% |
| Example 6 | 8.0 | 8.1 | 8.9 | 0.5% |
| Example 7 | 7.8 | 7.6 | 10.0 | 1.4% |
| Example 8 | 9.0 | 9.0 | 9.3 | 1.6% |
| Example 9 | 9.6 | 9.1 | 9.0 | 1.2% |
| Comparative Example 1 | 9.2 | 9.6 | 4.5 | 1.8% |
| Comparative Example 2 | 9.1 | 8.8 | 5.8 | 2.1% |
| Comparative Example 3 | 8.9 | 8.6 | 5.9 | 3.2% |
| Comparative Example 4 | 9.6 | 9.3 | 9.2 | 15.2% |
| Comparative Example 5 | 7.8 | 7.4 | 9.0 | 18.3% |
| Comparative Example 6 | 8.9 | 8.7 | 6.9 | 2.9% |
| Comparative Example 7 | 6.8 | 7.1 | 6.8 | 16.1% |
| Comparative Example 8 | 7.5 | 7.8 | 7.2 | 1.3% |
| Comparative Example 9 | 7.8 | 7.5 | 6.8 | 1.9% |

In the results of Table 1, KOSHI, HARI and NUMERI relate respectively to stiffness, anti-drape and softness, and are characterized by a range of values between 0 and 10, with a greater value indicating a stronger property. The yarn-making property is a percentage value which corresponds to the proportion of bobbins having a winding amount less than 3 kg to the total number of samples when winding at a draw winding amount of 3 kg. The total number of samples employed is 288 bobbins.

As is apparent from the data in above table, the fabrics made from the conjugated filaments according to the present invention (in Example 1 to 9) exhibit good stiffness and drapability in addition to higher softness characteristics and more excellent yarn-making property in comparison to the fabrics and yarns made from the conventional conjugated filaments (in comparative examples 1 to 9).

Having now fully described the invention, it will be apparent to one of ordinary skill in the art that many changes and modifications can be made thereto without departing from the spirit or scope of the invention as set forth herein.

What is claimed as new and is intended to be secured by Letters Patent is:

1. In a conjugated filament for producing a superfine filament comprising a polymer component (A) and a polymer component (B) which is more soluble than polymer (A), wherein the improvement comprises:

said conjugated filament having a circular cross-sectional configuration with an areal center in which the polymer component (A) is divided into not less than 5 segments by portions of polymer (B) radially projecting outward to the surface of the conjugated filament from an inner circular portion of polymer (B) which encloses an inner center segment of polymer (A), which is one of said not less than 5 segments, said center segment having an areal center which is displaced from the areal center of the circular cross-section of the filament by a distance (r) which has a relationship with the radius (R) of the circular cross-section of the conjugated filament as follows:

$$\frac{R}{300} \leqq r \leqq \frac{R}{2}.$$

2. The conjugated filament according to claim 1, wherein r is in the range of $$\frac{R}{300} \leqq r \leqq \frac{R}{50}.$$

3. The conjugated filament according to claim 1, wherein the proportions of said polymer (A) and said polymer (B) in the filament comprise 60 to 90 percent by weight and 10 to 40 percent by weight respectively, of the conjugated filament.

4. The conjugated filament according to claim 1, wherein the amounts of said polymer (A) and polymer (B) in the conjugated filament comprise 70 to 85 percent by weight and 15 to 30 percent by weight, respectively of the conjugated filament.

5. The conjugated filament according to claim 1, wherein the polymer of segments of polymer (A) is a member selected from the group consisting of polyamides and polyesters.

6. The conjugated filament according to claim 1, wherein said polymer (B) is a copolymerized copolyester obtained by copolymerizing one or two kind(s) of dicarboxylic acid(s) terephthalic acid having polyalkyleneglycol or metal sulfonate group.

7. The conjugated filament according to claim 1, wherein the number of the polymer (A) segments is 5 to 22.

* * * * *